US012371797B2

(12) United States Patent
Reisinger

(10) Patent No.: US 12,371,797 B2
(45) Date of Patent: Jul. 29, 2025

(54) ETCHING A DESIGN ON A METAL SURFACE COVERED WITH A PIGMENTED LAYER

(71) Applicant: Adrienne Reisinger, Valencia, CA (US)

(72) Inventor: Adrienne Reisinger, Valencia, CA (US)

( * ) Notice: Subject to any disclaimer, the term of this patent is extended or adjusted under 35 U.S.C. 154(b) by 224 days.

(21) Appl. No.: 18/189,793

(22) Filed: Mar. 24, 2023

(65) Prior Publication Data

US 2024/0318318 A1 Sep. 26, 2024

(51) Int. Cl.
*C23F 1/02* (2006.01)

(52) U.S. Cl.
CPC ..... *C23F 1/02* (2013.01)

(58) Field of Classification Search
None
See application file for complete search history.

(56) References Cited

U.S. PATENT DOCUMENTS 11,826,775 B2 * 11/2023 Rodriguez ..... B05C 17/06
2005/0112275 A1 * 5/2005 Rodriguez ..... G09F 7/16 427/258
2008/0245768 A1 * 10/2008 Cottrell ..... C23F 1/02 216/42
2018/0242457 A1 * 8/2018 Shpaisman ..... C23F 1/00

FOREIGN PATENT DOCUMENTS

WO WO-2004053197 A2 * 6/2004 ..... B22F 3/10
WO WO-2011146912 A2 * 11/2011 ..... B41C 1/148

* cited by examiner

*Primary Examiner* — Shamim Ahmed
(74) *Attorney, Agent, or Firm* — Perkins Coie LLP

(57) ABSTRACT

The system applies a stencil defining a design to a stencil layer including an acid-resistant surface and an adhesive surface. The system adheres the stencil layer to the metal surface covered with the pigmented layer, where the adhesive surface attaches to the metal surface covered with the pigmented layer. The system applies a coat of low-acidity gel formulated to at least partially separate the pigmented layer from the metal surface and to not abrade the acid-resistant surface and the adhesive surface. The system applies low heat to the coat of low-acidity gel and removes the coat of low-acidity gel, thereby removing at least a portion of the pigmented layer from the metal surface. The system separates remaining pigmented layer from the metal surface using a pick tool or a gust of air.

20 Claims, 8 Drawing Sheets

ETCHING A DESIGN ON A METAL SURFACE COVERED WITH A PIGMENTED LAYER

BACKGROUND

Laser cutting is a technology that uses a laser to vaporize materials, resulting in a cut edge. While typically used for industrial manufacturing applications, it is now used by schools, small businesses, architects, and hobbyists. Laser cutting works by directing the output of a high-powered laser, most commonly through optics. The laser optics and CNC (computer numerical control) are used to direct the laser beam to the material. A commercial laser for cutting materials uses a motion control system to follow a CNC or G-code of the pattern to be cut onto the material. The focused laser beam is directed at the material, which then either melts, burns, vaporizes away, or is blown away by a jet of gas, leaving an edge with a high-quality surface finish. Laser cutting is expensive and is out of reach for most individuals and small businesses.

BRIEF DESCRIPTION OF THE DRAWINGS

Detailed descriptions of implementations of the present invention will be described and explained through the use of the accompanying drawings.

Figure 1:
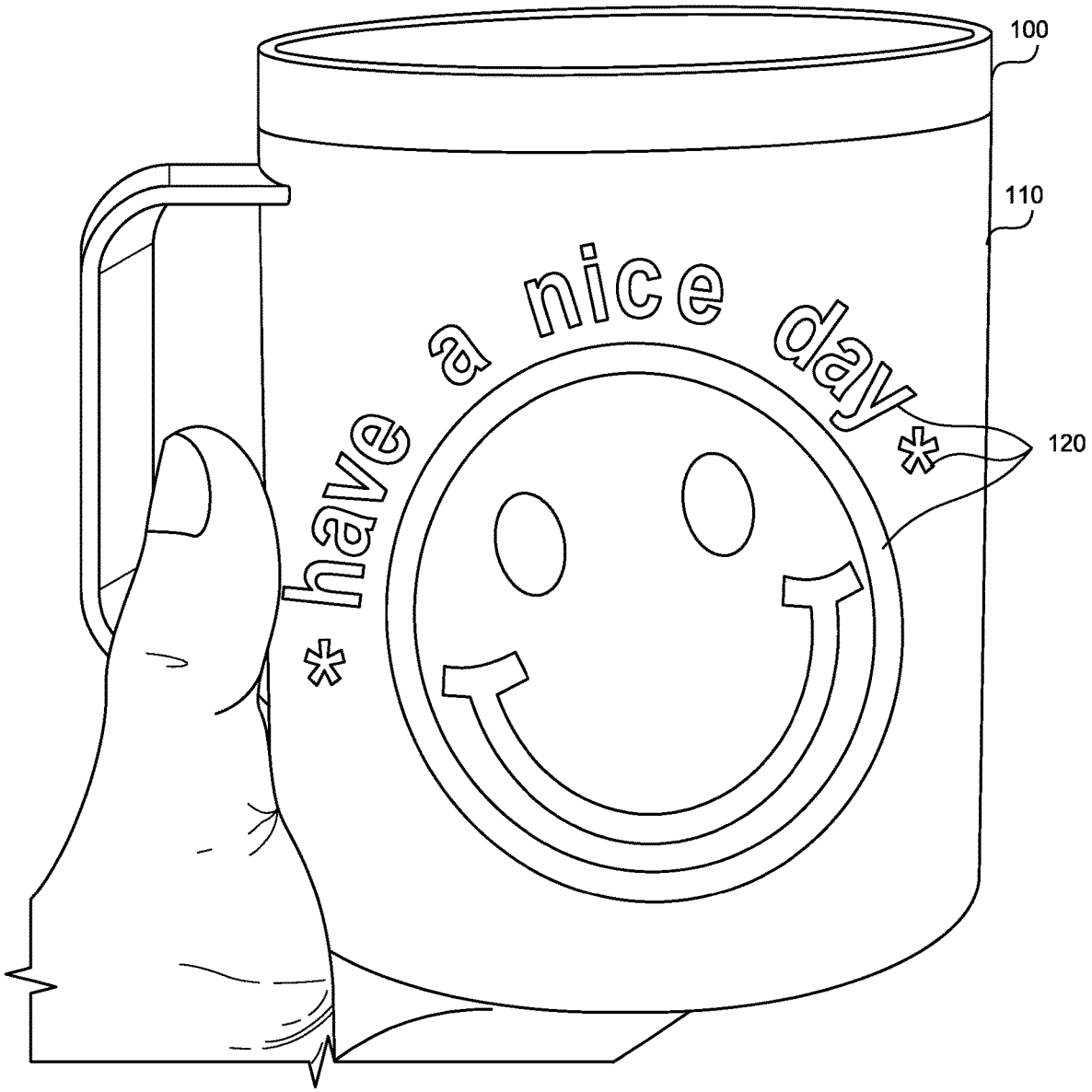
FIG. 1 shows a metal surface with a pigmented layer etched with a design according to the system and method described in this application.

The technologies described herein will become more apparent to those skilled in the art from studying the Detailed Description in conjunction with the drawings. Embodiments or implementations describing aspects of the invention are illustrated by way of example, and the same references can indicate similar elements. While the drawings depict various implementations for the purpose of illustration, those skilled in the art will recognize that alternative implementations can be employed without departing from the principles of the present technologies. Accordingly, while specific implementations are shown in the drawings, the technology is amenable to various modifications.

DETAILED DESCRIPTION

Disclosed here is a low-cost system and method to etch a design on a metal surface covered with a pigmented layer. A laser cutter can cost over $2000, while the disclosed system and method cost less than $20.

The metal surface can be curved or planar and can include painted metal, a powder-coated surface, and/or enameled metal. The system can apply a stencil defining the design to a stencil layer. The design can include lettering, geometric shapes, curved lines, straight lines, etc. The stencil layer includes a vinyl surface and an adhesive surface. The system can adhere the stencil layer to the metal surface covered with the pigmented layer, where the adhesive surface attaches to the metal surface covered with the pigmented layer. The stencil layer can cover the whole metal surface.

The system can apply a coat of low-acidity citrus-based gel, such as Citristrip, where the low-acidity citrus-based gel is formulated to at least partially separate the pigmented layer from the metal surface and to not abrade the vinyl surface and the adhesive surface. The system can apply low heat not exceeding 150° F. and preferably at 120° F., to the coat of low-acidity citrus-based gel, and after a predetermined amount of time, such as 60 seconds for a painted pigmented layer or 20 minutes for a powder-coated pigmented layer, the system can remove the coat of low-acidity citrus-based gel, thereby removing at least a portion of the pigmented layer from the metal surface. The system can separate the remaining pigmented layer from the metal surface using a pick tool or a gust of air, such as a blow-dryer or compressed air. Once the pigmented layer is separated from the metal surface, the lack of color on the metal surface defines the design.

The description and associated drawings are illustrative examples and are not to be construed as limiting. This disclosure provides certain details for a thorough understanding and an enabling description of these examples. One skilled in the relevant technology will understand, however, that the invention can be practiced without many of these details. Likewise, one skilled in the relevant technology will understand that the invention can include well-known structures or features that are not shown or described in detail, to avoid unnecessarily obscuring the descriptions of examples.

Etching a Design on a Metal Surface Covered with a Pigmented Layer

FIG. 1 shows a surface with a pigmented layer etched with a design according to the system and method described in this application. The system and method described in this application can be performed by a person or in a manufacturing setting, where machines programmed to perform specific steps operate in tandem to create the etched design.

The surface 100 can be metal, glass, ceramic, plastic, etc., and can be planar or curved as shown in FIG. 1. The pigmented layer 110 can be painted on the surface 100, can be a powder coat on the metal surface, and/or can be an enamel on the metal surface. The disclosed method uses a low-acidity gel, such as a low-acidity citrus-based gel such as Citristrip, to etch the design 120 onto the surface 100 with the pigmented layer 110, thus providing a low-cost alternative to laser-based etching methods. Prior to initiating the process, the surface 100 with the pigmented layer 110 needs to be thoroughly cleaned, for example with dish soap and water.

Figure 2:
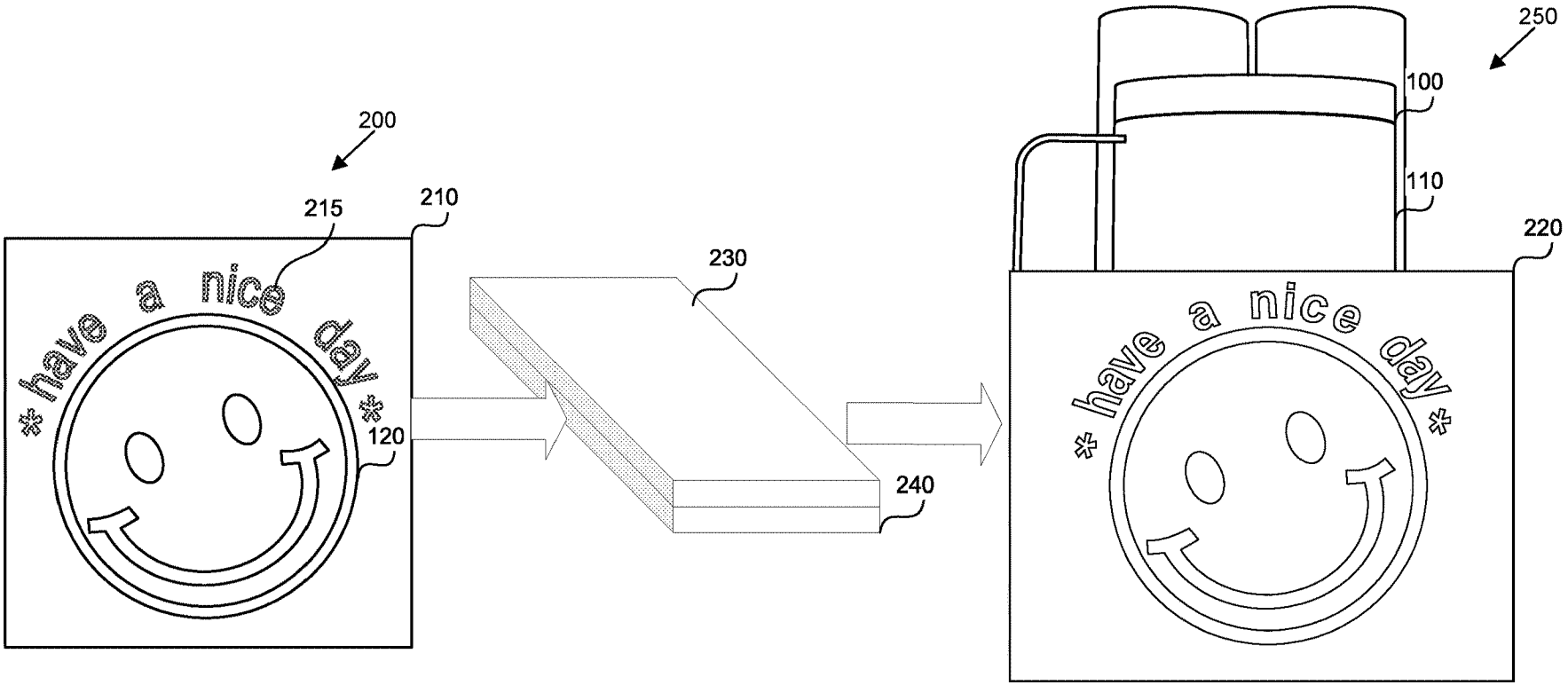
FIG. 2 shows creation of the stencil and application of the stencil to the metal surface with the pigmented layer.

FIG. 2 shows creation of the stencil and application of the stencil to the metal surface with the pigmented layer. In step 200, a stencil 210 of the design 120 is created. The area 215, corresponding to the design 120, that is going to be etched out of the pigmented layer 110 in FIG. 1, is removed from the stencil 210. The stencil 210 can be transferred to a stencil layer 220 using transfer paper.

The stencil layer 220 can have a top surface 230 made out of acid-resistant material, such as vinyl, and a bottom surface 240 made out of an adhesive. The vinyl can be Oracal 651 vinyl. The adhesive is also resistant to the low-acidity gel, thus preventing the gel from seeping and damaging the pigmented layer 110 during etching.

In step 250, the stencil layer 220 is applied to the metal surface 100 with the adhesive layer adhering to the pigmented layer 110.

Figure 3:
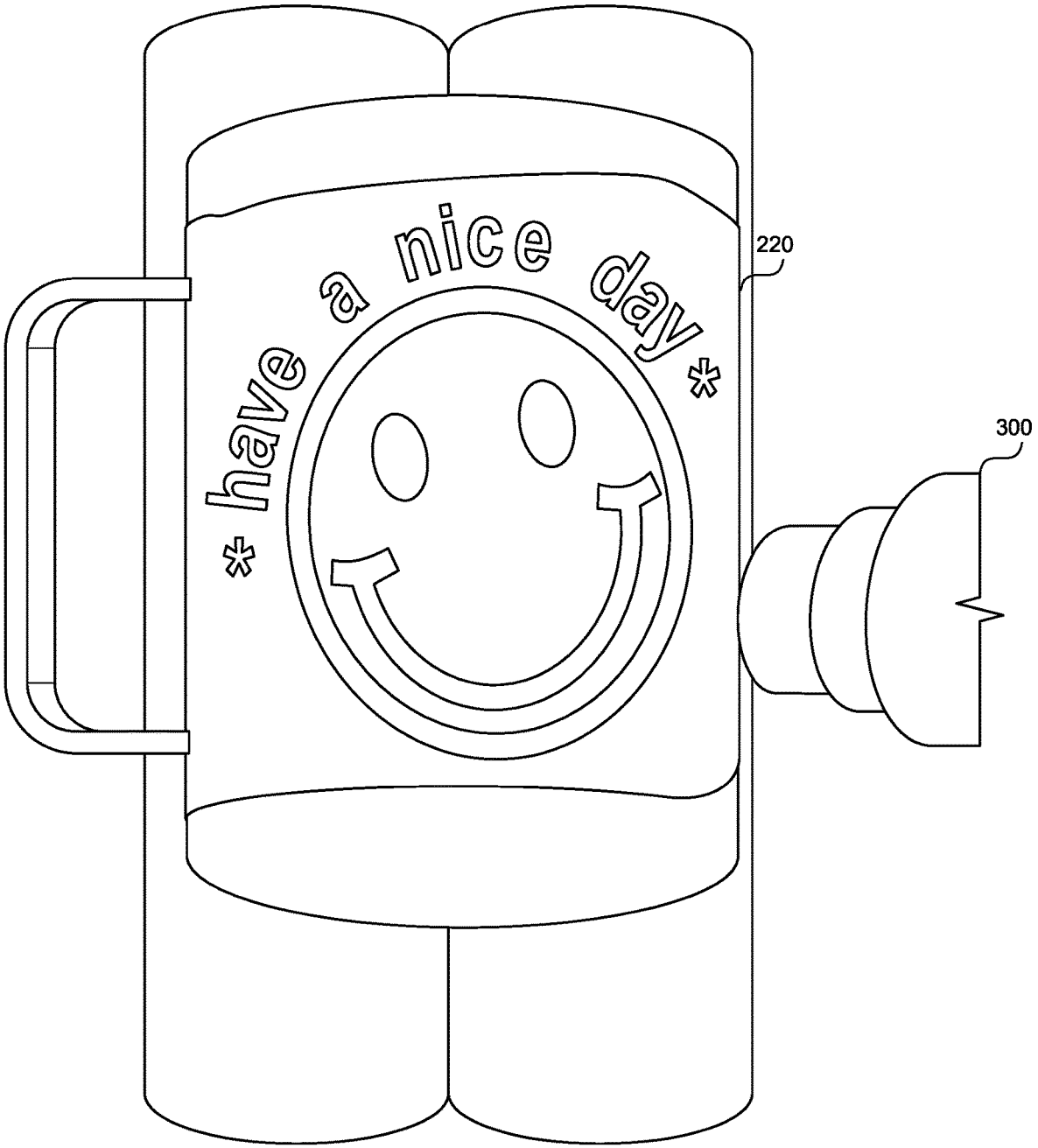
FIG. 3 shows techniques to ensure even attachment between the stencil layer and the pigmented layer.

FIG. 3 shows techniques to ensure even attachment between the stencil layer 220 and the pigmented layer 110 in FIG. 1. The stencil layer 220 can be rubbed down with a squeegee-type tool, working out wrinkles and bubbles. A heat gun 300 set on low heat, not to exceed 150° F. and preferably at 120° F., can be applied to the stencil layer 220 to help adhere the adhesive to the pigmented layer 110. In addition, using a brayer tool can help push the stencil onto the pigmented layer 110. The metal surface 100 in FIG. 1 can be completely covered with the stencil layer 220 and other scraps of acid-resistant material preventing the low-acidity gel from damaging the pigmented layer 110 outside of the design 120.

Figure 4:
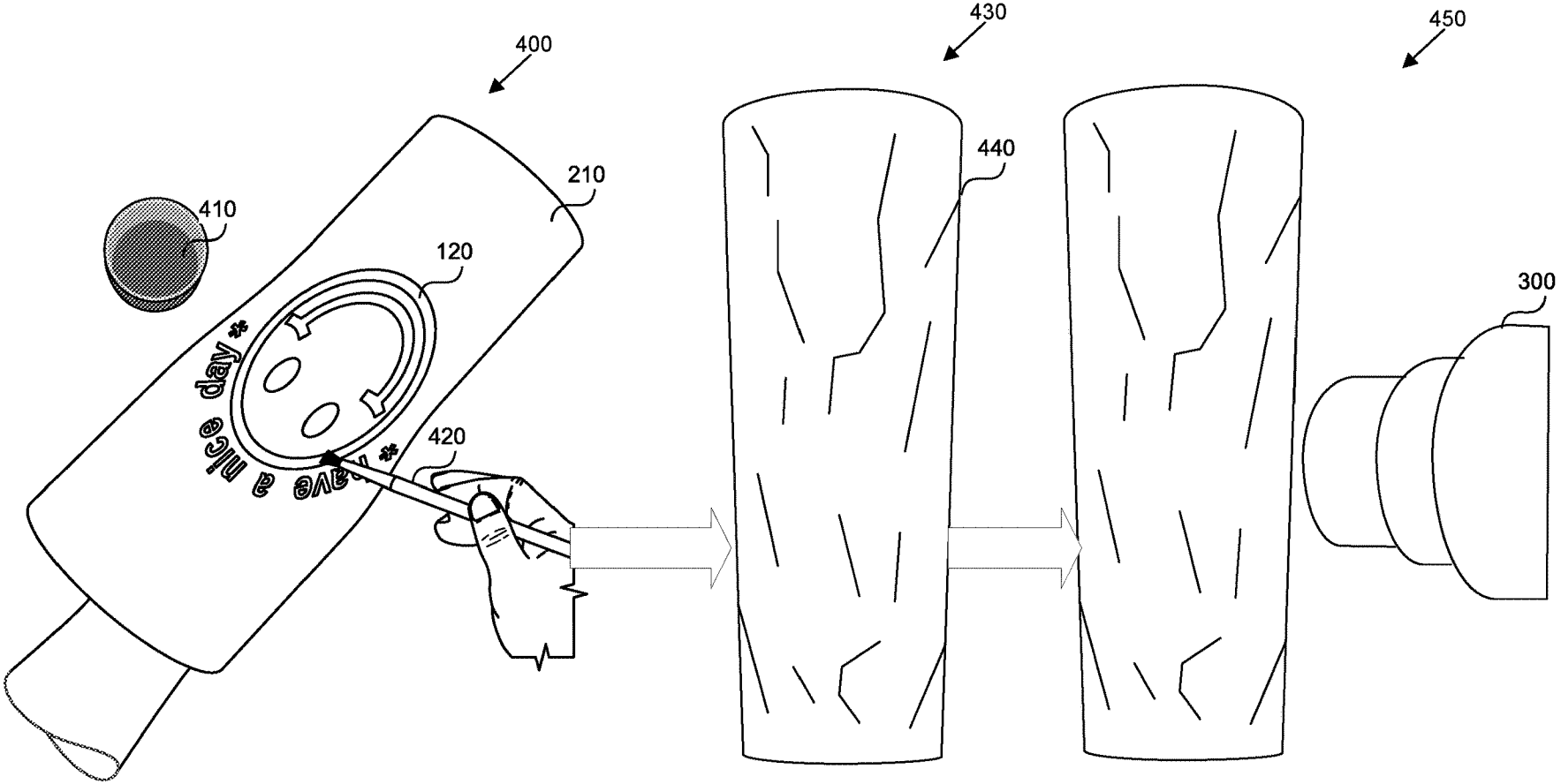
FIG. 4 shows application of the low-acidity gel and heat.

FIG. 4 shows application of the low-acidity gel and heat. In step 400, a thick coat of the low-acidity gel 410 can be applied, using the flat paintbrush 420, to the pigmented layer 110 in FIG. 1 visible through the design 120 on the stencil layer 220. In step 430, the metal surface 100 in FIG. 1, along with the stencil layer 220, can be covered with a pliable metal surface 440, such as aluminum foil, thus enclosing the metal surface 100.

In step 450, heat can be applied to the foiled metal surface. The heat can come from an external source such as a heat gun 300, which can be moved in sweeping motions across the metal surface, evenly distributing heat across the design 120. A heat gun 300 set on low heat, not to exceed 150° F. and preferably at 120° F., can be applied to the foiled surface to speed up the etching process. If there is too much heat, wrinkles can form in the stencil layer 220 and the design 120 can be distorted. Heat should be applied the curved or ends of the stencil layer 220.

Figure 5:
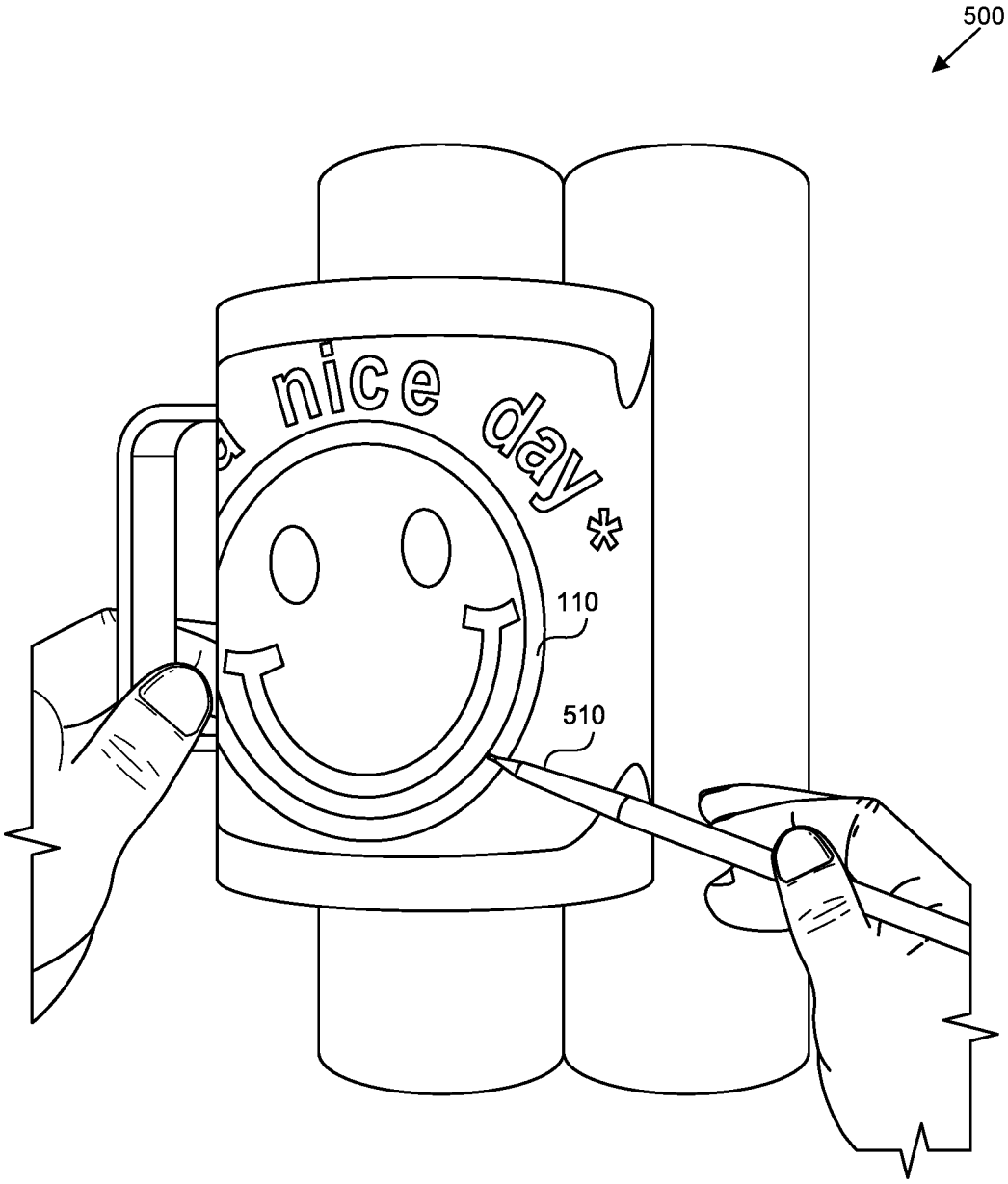
FIG. 5 shows a method to check whether the low-acidity gel should be removed from the metal surface.

FIG. 5 shows a method to check whether the low-acidity gel should be removed from the metal surface. In step 500, after a predetermined amount of time, such as 60 seconds, the foil 440 in FIG. 4 can be removed, and with a pick tool 510, such as a dental tool, a skewer, a toothpick, or any pointed tool, a scratch test can be performed by scratching at the pigmented layer 110 to determine whether the pigmented layer is separating from the metal surface 100 in FIG. 1. Instead of a pick tool 510, a gust of compressed air or a blow-dryer can be used. The scratch test can be performed at least three to four times at a minimum to get the best result, because the scratch test also helps to break the seal between the pigmented layer 110 and the metal surface 100 in FIG. 1, thus aiding the etching process. The scratch test should be performed over the entire design 120 in FIG. 1.

Depending on the type of the pigmented layer, the time to perform the scratch test can vary. The pigmented layer can be paint, powder coat, or enamel. For all types of pigmented layers, after the first pass of low-acidity gel, foil and heat, testing of the surface can be performed. If the pigmented layer is paint, the pigmented layer lifts faster than a powder-coated layer, and can only require 2-3 passes. For powder-coated surface, separating the pigmented layer can require several passes that can take 20 to 40 minutes.

If the low-acidity gel 410 in FIG. 4 has dried up, too much heat was applied, and steps 400, 430, 450, and 500 can be repeated. Similarly, if the pigmented layer 110 is not separating from the metal surface 100, steps 400, 430, 450, and 500 can be repeated.

If the pigmented layer 110 is separating from the metal surface 100, the low-acidity gel 410 can be removed from the metal surface 100, as described below.

Instead of the scratch test or in addition to the scratch test, an expected time for the pigmented layer 110 to separate from the metal surface 100 can be determined based on the type of the pigmented layer. For example, the pigmented layer can be paint, powder coat, or enamel. If the pigmented layer is paint, the expected time can be 60 seconds, while if the pigmented layer is powder-coated, expected time can be 20 to 40 minutes. Based on the type of the pigmented layer, the scratch test can be performed after 60 seconds or after 20 minutes. Alternatively, no scratch test needs to be performed, and after 60 seconds or after 20 minutes, the process can continue as described below.

Figure 6:
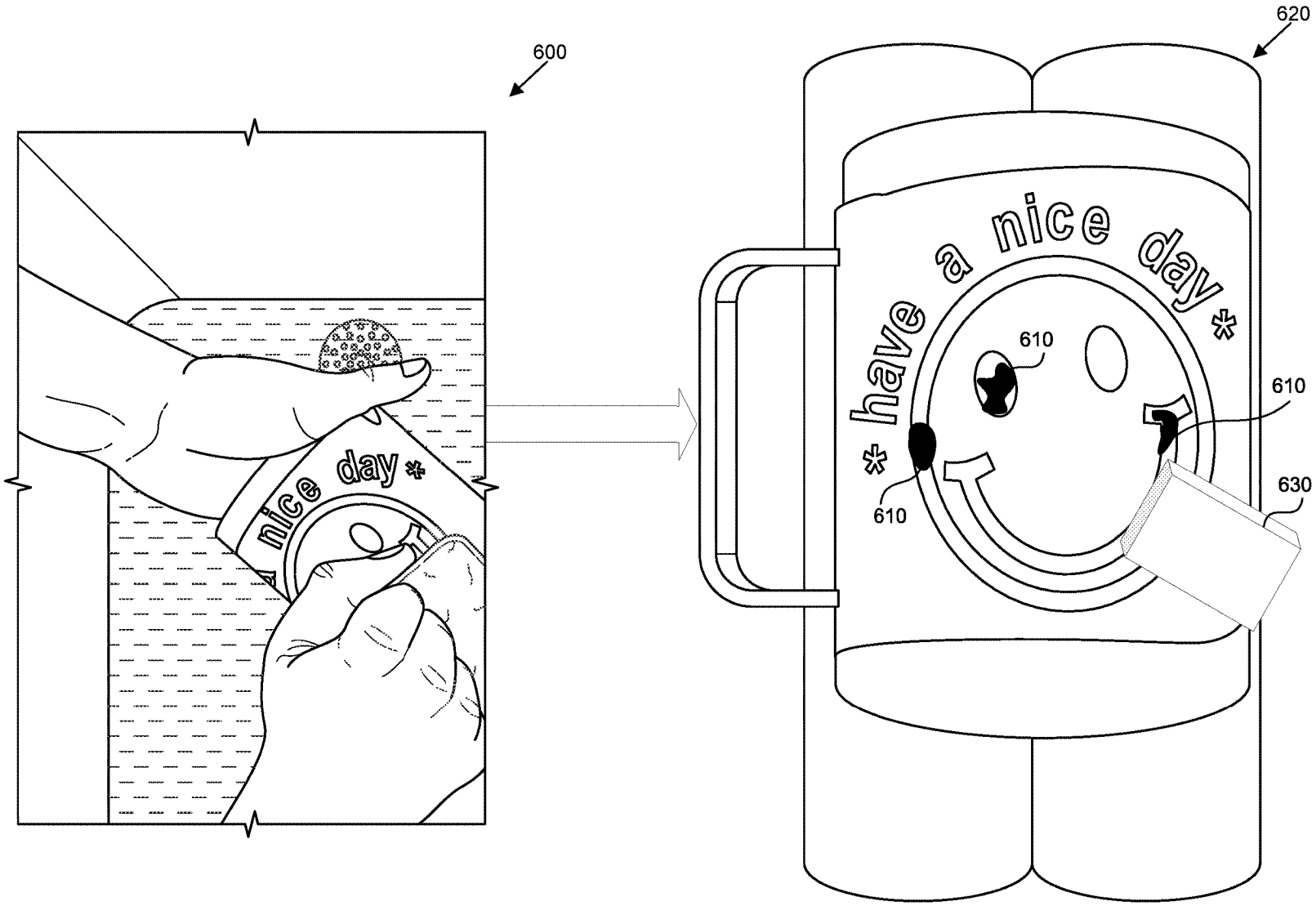
FIG. 6 shows removing the low-acidity gel from the surface.

FIG. 6 shows removing the low-acidity gel from the surface. After the scratch test, once the metal surface 100 has most of the low-acidity gel 410 in FIG. 4 removed, the low-acidity gel 410 can be blotted off, while carefully avoiding rubbing or scratching, from the metal surface 100 with a non-scratch pad to clean off as much of the gel as possible. The non-scratch pad can be a wet wipe or rag to not damage the remaining surface. If there is rubbing or scratching, the metal surface 100 can be damaged and show scratch signs.

In step 600, the low-acidity gel 410 residue can be washed under a faucet. The stencil layer 220 in FIG. 2 can be removed. The removal can occur under the faucet with warm/hot water, or the stencil layer 220 can be pulled off from the metal surface 100 in FIG. 1. The surface can be dried. At this point, the design 120 can still have remnants 610 of the pigmented layer 110 left.

In step 620, with a soft rubbing surface 630, the remnants 610 can be loosened from the metal surface 100. The soft rubbing surface 630 can be a paper towel, an eraser such as a glue eraser, etc. There should be no scrubbing of the remnant 610 because scrubbing can damage the metal surface 100 and leave scratch marks. If after step 620 there are still remnants 610 on the metal surface 100, a pick tool, a gust of compressed air, or a blow-dryer can be used to separate the remnants 610 from the metal surface 100 and remove all the remnants in the design area.

Figure 7:
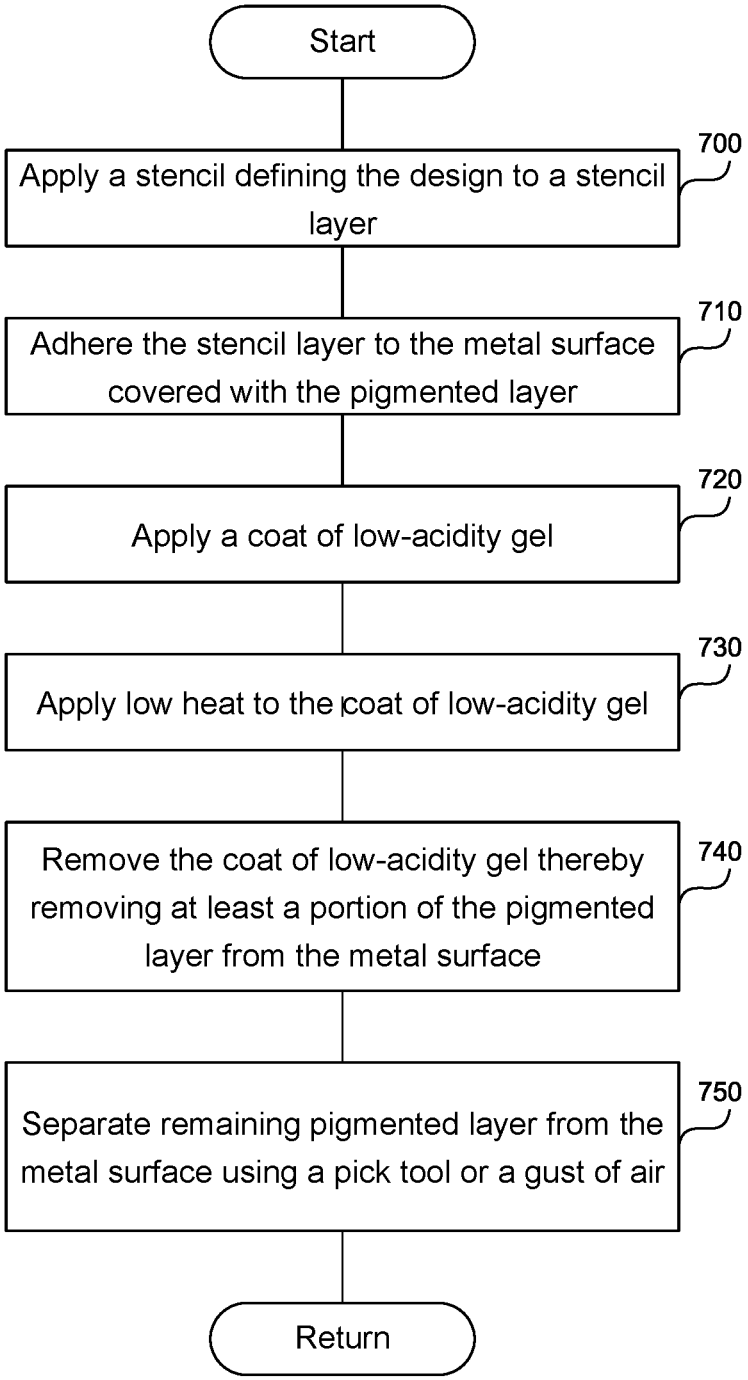
FIG. 7 is a flowchart of a method to etch a design on a surface covered with a pigmented layer.

FIG. 7 is a flowchart of a method to etch a design on a surface covered with a pigmented layer. A hardware or software processor can cause the instructions described in this application to be executed. The hardware or the software processor can be part of a manufacturing system configured to etch a design onto a pigmented layer covering the surface such as a metal, glass, ceramic, plastic, etc., surface. The surface can be curved or planar and can include painted metal, a powder-coated surface, and/or enameled metal.

In step 700, the processor can apply a stencil defining the design to a stencil layer, where the stencil layer includes an acid-resistant surface and an adhesive surface. The acid-resistant surface can be vinyl such as Oracal 651.

In step 710, the processor can adhere the stencil layer to the surface covered with the pigmented layer, where the adhesive surface attaches to the surface covered with the pigmented layer. The stencil layer can cover the whole surface to prevent exposure of the surface to the etching agent, e.g., the low-acidity gel.

In step 720, the processor can apply a coat of low-acidity gel, such as a citrus-based gel. The citrus-based gel can be Citristrip. The low-acidity gel is formulated to at least partially separate the pigmented layer from the surface and to not abrade the acid-resistant surface and the adhesive surface. The coat can be more than two millimeters thick.

In step 730, the processor can apply low heat to the coat of low-acidity gel. The heat can be up to 150° F., preferably up to 120° F. The heat can be applied evenly across the design. If the area of the heat source is smaller than the area of the design, e.g., the heat source is a heat gun, the processor can move the heat gun in sweeping motions across the design to distribute the heat evenly. If the area of the heat source is the same as the area of the design or greater, the heat can be applied to the design without moving the heat source.

In step 740, the processor can remove the coat of low-acidity gel, thereby removing at least a portion of the pigmented layer from the surface. In step 750, the processor can separate the remaining pigmented layer from the surface using a pick tool or a gust of air.

Prior to applying the coat of low-acidity gel, the processor can clean the surface covered with the pigmented layer using soap, such as dish soap, and water.

After adhering the stencil layer to the surface covered with the pigmented layer, the processor can remove wrinkles and bubbles from the stencil layer. First, the processor can slide a first surface across the stencil layer. The first surface can be a rubber surface such as a rubber blade including a squeegee. Second, the processor can press the stencil layer down onto the surface covered with the pigmented layer using a roller.

After adhering the stencil layer to the surface covered with the pigmented layer, the processor can aid the adhesive surface to adhere to the surface covered with the pigmented layer by applying low heat to the stencil layer and applying pressure with a roller to the stencil layer.

Prior to applying low heat to the coat of low-acidity gel, the processor can enclose the coat of low-acidity gel and the surface covered with the pigmented layer using a flexible sheet. The flexible sheet can be a metallic flexible sheet such as an aluminum foil. The processor can uniformly distribute the low heat across the low-acidity gel by applying the low heat to the coat of low-acidity gel through the flexible sheet.

After applying the low heat, the processor can determine whether the pigmented layer is separating from the surface by, for example, performing the scratch test using a pick tool or a gust of air, as described in this application. Upon determining that the pigmented layer is not separating from the surface, the processor can apply an additional coat of low-acidity gel. Upon determining the pigmented layer is separating from the surface, the processor can remove the coat of low-acidity gel based on whether the pigmented layer is separating from the surface.

Alternatively, the processor can determine a type associated with the pigmented layer, such as paint, powder coat, or enamel. Based on the type associated with the pigmented layer, the processor can determine a predetermined amount of time. For example, if the type is paint, the predetermined amount of time can be 60 seconds, while if the type is powder coat, the predetermined amount of time can be 20 minutes. After applying the low heat, the processor can wait for the predetermined amount of time. After the predetermined amount of time, the processor can remove the coat of low-acidity gel.

Computer System

Figure 8:
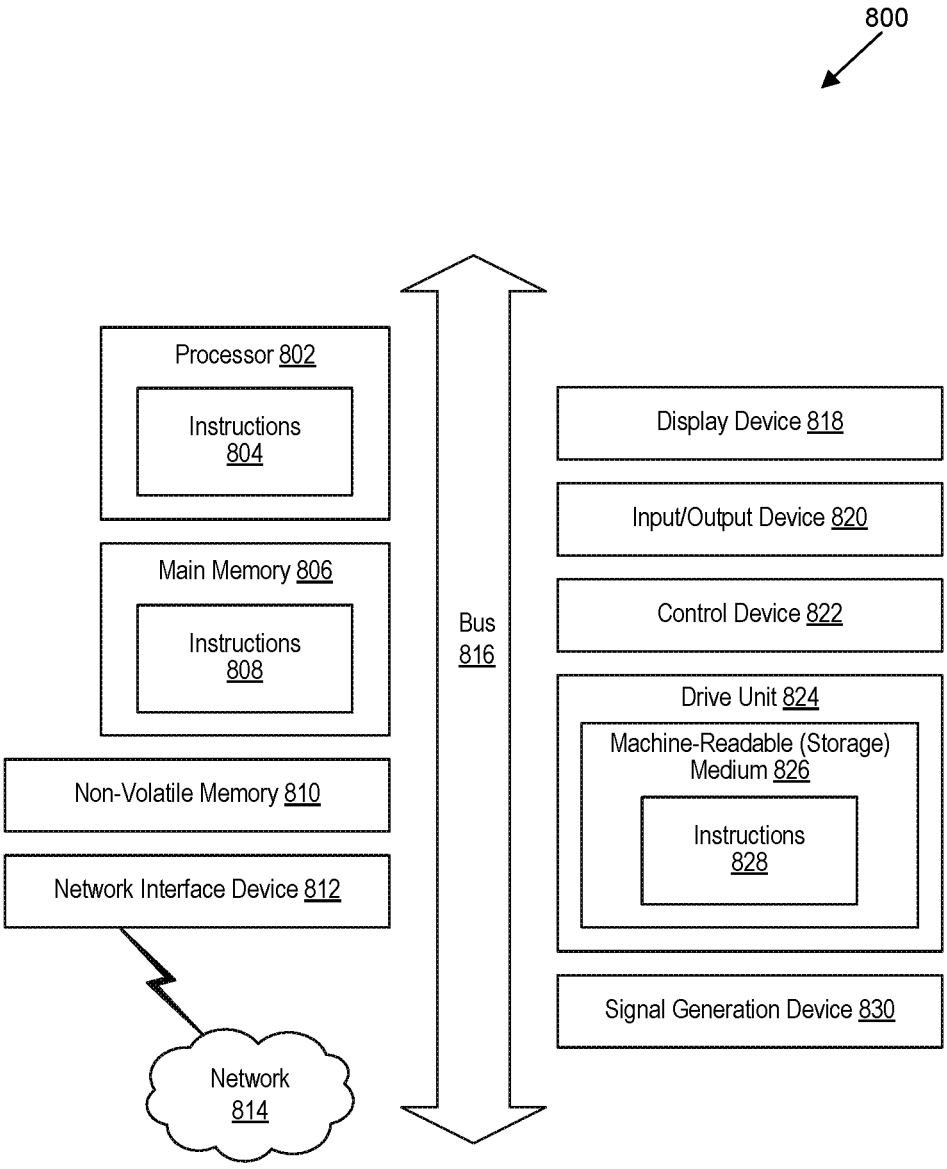
FIG. 8 is a block diagram that illustrates an example of a computer system in which at least some operations described herein can be implemented.

FIG. 8 is a block diagram that illustrates an example of a computer system 800 in which at least some operations described herein can be implemented. As shown, the computer system 800 can include: one or more processors 802, main memory 806, non-volatile memory 810, a network interface device 812, video display device 818, an input/output device 820, a control device 822 (e.g., keyboard and pointing device), a drive unit 824 that includes a storage medium 826, and a signal generation device 830 that are communicatively connected to a bus 816. The bus 816 represents one or more physical buses and/or point-to-point connections that are connected by appropriate bridges, adapters, or controllers. Various common components (e.g., cache memory) are omitted from FIG. 8 for brevity. Instead, the computer system 800 is intended to illustrate a hardware device on which components illustrated or described relative to the examples of the Figures and any other components described in this specification can be implemented.

The computer system 800 can take any suitable physical form. For example, the computing system 800 can share a similar architecture as that of a server computer, personal computer (PC), tablet computer, mobile telephone, game console, music player, wearable electronic device, network-connected ("smart") device (e.g., a television or home assistant device), AR/VR systems (e.g., head-mounted displays), or any electronic device capable of executing a set of instructions that specify action(s) to be taken by the computing system 800. In some implementations, the computer system 800 can be an embedded computer system, a system-on-chip (SOC), a single-board computer system (SBC) or a distributed system such as a mesh of computer systems or can include one or more cloud components in one or more networks. Where appropriate, one or more computer systems 800 can perform operations in real time, near real time, or in batch mode.

The network interface device 812 enables the computing system 800 to mediate data in a network 814 with an entity that is external to the computing system 800 through any communication protocol supported by the computing system 800 and the external entity. Examples of the network interface device 812 include a network adapter card, a wireless network interface card, a router, an access point, a wireless router, a switch, a multilayer switch, a protocol converter, a gateway, a bridge, bridge router, a hub, a digital media receiver, and/or a repeater, as well as all wireless elements noted herein.

The memory (e.g., main memory 806, non-volatile memory 810, machine-readable medium 826) can be local, remote, or distributed. Although shown as a single medium, the machine-readable medium 826 can include multiple media (e.g., a centralized/distributed database and/or associated caches and servers) that store one or more sets of instructions 828. The machine-readable (storage) medium 826 can include any medium that is capable of storing, encoding, or carrying a set of instructions for execution by the computing system 800. The machine-readable medium 826 can be non-transitory or comprise a non-transitory device. In this context, a non-transitory storage medium can include a device that is tangible, meaning that the device has a concrete physical form, although the device can change its physical state. Thus, for example, non-transitory refers to a device remaining tangible despite this change in state.

Although implementations have been described in the context of fully functioning computing devices, the various examples are capable of being distributed as a program product in a variety of forms. Examples of machine-readable storage media, machine-readable media, or computer-readable media include recordable-type media such as volatile and non-volatile memory devices 810, removable flash memory, hard disk drives, optical disks, and transmission-type media such as digital and analog communication links.

In general, the routines executed to implement examples herein can be implemented as part of an operating system or a specific application, component, program, object, module, or sequence of instructions (collectively referred to as "computer programs"). The computer programs typically comprise one or more instructions (e.g., instructions 804, 808,

828) set at various times in various memory and storage devices in computing device(s). When read and executed by the processor 802, the instruction(s) cause the computing system 800 to perform operations to execute elements involving the various aspects of the disclosure.

Remarks

The terms "example," "embodiment," and "implementation" are used interchangeably. For example, references to "one example" or "an example" in the disclosure can be, but not necessarily are, references to the same implementation; and such references mean at least one of the implementations. The appearances of the phrase "in one example" are not necessarily all referring to the same example, nor are they separate or alternative examples mutually exclusive of other examples. A feature, structure, or characteristic described in connection with an example can be included in another example of the disclosure. Moreover, various features are described that can be exhibited by some examples and not by others. Similarly, various requirements are described which can be requirements for some examples but not for other examples.

The terminology used herein should be interpreted in its broadest reasonable manner, even though it is being used in conjunction with certain specific examples of the invention. The terms used in the disclosure generally have their ordinary meanings in the relevant technical art, within the context of the disclosure, and in the specific context where each term is used. A recital of alternative language or synonyms does not exclude the use of other synonyms. Special significance should not be placed upon whether or not a term is elaborated or discussed herein. The use of highlighting has no influence on the scope and meaning of a term. Further, it will be appreciated that the same thing can be said in more than one way.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling or connection between the elements can be physical, logical, or a combination thereof. Additionally, the words "herein," "above," "below," and words of similar import can refer to this application as a whole and not to any particular portions of this application. Where context permits, words in the above Detailed Description using the singular or plural number may also include the plural or singular number respectively. The word "or" in reference to a list of two or more items covers all of the following interpretations of the word: any of the items in the list, all of the items in the list, and any combination of the items in the list. The term "module" refers broadly to software components, firmware components, and/or hardware components.

While specific examples of technology are described above for illustrative purposes, various equivalent modifications are possible within the scope of the invention, as those skilled in the relevant art will recognize. For example, while processes or blocks are presented in a given order, alternative implementations can perform routines having steps, or employ systems having blocks, in a different order, and some processes or blocks may be deleted, moved, added, subdivided, combined, and/or modified to provide alternative or sub-combinations. Each of these processes or blocks can be implemented in a variety of different ways. Also, while processes or blocks are at times shown as being performed in series, these processes or blocks can instead be performed or implemented in parallel or can be performed at different times. Further, any specific numbers noted herein are only examples such that alternative implementations can employ differing values or ranges.

Details of the disclosed implementations can vary considerably in specific implementations while still being encompassed by the disclosed teachings. As noted above, particular terminology used when describing features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed herein, unless the above Detailed Description explicitly defines such terms. Accordingly, the actual scope of the invention encompasses not only the disclosed examples, but also all equivalent ways of practicing or implementing the invention under the claims. Some alternative implementations can include additional elements to those implementations described above or include fewer elements.

Any patents and applications and other references noted above, and any that may be listed in accompanying filing papers, are incorporated herein by reference in their entireties, except for any subject matter disclaimers or disavowals, and except to the extent that the incorporated material is inconsistent with the express disclosure herein, in which case the language in this disclosure controls. Aspects of the invention can be modified to employ the systems, functions, and concepts of the various references described above to provide yet further implementations of the invention.

To reduce the number of claims, certain implementations are presented below in certain claim forms, but the applicant contemplates various aspects of an invention in other forms. For example, aspects of a claim can be recited in a means-plus-function form or in other forms, such as being embodied in a computer-readable medium. A claim intended to be interpreted as a means-plus-function claim will use the words "means for." However, the use of the term "for" in any other context is not intended to invoke a similar interpretation. The applicant reserves the right to pursue such additional claim forms in either this application or in a continuing application.

I claim:

1. A method to etch a design on a metal surface covered with a pigmented layer comprising:

applying a stencil defining the design to a stencil layer,
wherein the stencil layer includes a vinyl surface and an adhesive surface;

adhering the stencil layer to the metal surface covered with the pigmented layer,
wherein the adhesive surface attaches to the metal surface covered with the pigmented layer;

applying a coat of citrus-based gel,
wherein the citrus-based gel is formulated to at least partially separate the pigmented layer from the metal surface, and
wherein the citrus-based gel is formulated to not abrade the vinyl surface and the adhesive surface;

applying heat not exceeding 150° F. to the coat of citrus-based gel;

removing, after applying the heat, the coat of citrus-based gel, thereby removing at least a portion of the pigmented layer from the metal surface; and separating a remaining pigmented layer from the metal surface using a pick tool or a gust of air.

2. The method of claim 1, comprising:

determining a type associated with the pigmented layer, wherein the type includes paint, powder coat, or enamel;

based on the type associated with the pigmented layer, determining a predetermined amount of time;

after applying the heat, waiting for the predetermined amount of time; and removing the coat of citrus-based gel after the predetermined amount of time.

3. The method of claim 1, comprising:

prior to applying the coat of citrus-based gel, cleaning the metal surface covered with the pigmented layer using soap and water.

4. The method of claim 1, comprising:

after adhering the stencil layer to the metal surface covered with the pigmented layer, removing wrinkles and bubbles from the stencil layer by:

sliding a first surface across the stencil layer; and pressing the stencil layer down onto the metal surface covered with the pigmented layer.

5. The method of claim 1, comprising:

after adhering the stencil layer to the metal surface covered with the pigmented layer, aiding the adhesive surface to adhere to the metal surface covered with the pigmented layer by:

applying heat to the stencil layer; and applying pressure with a roller to the stencil layer.

6. The method of claim 1, comprising:

prior to applying heat not exceeding 150° F. to the coat of citrus-based gel, enclosing the coat of citrus-based gel and the metal surface covered with the pigmented layer using a flexible sheet; and uniformly distributing the heat across the citrus-based gel by applying the heat not exceeding 150° F. to the coat of citrus-based gel through the flexible sheet.

7. The method of claim 1, comprising:

after applying the heat, determining whether the pigmented layer is separating from the metal surface; and selectively applying additional coat of citrus-based gel or removing the coat of citrus-based gel based on whether the pigmented layer is separating from the metal surface.

8. A method of etching a design on a metal surface comprising:

applying a stencil defining the design to a stencil layer, wherein the stencil layer includes a vinyl surface and an adhesive surface;

adhering the stencil layer to the metal surface covered with a pigmented layer, wherein the adhesive surface attaches to the metal surface covered with the pigmented layer;

applying a coat of citrus-based gel, wherein the citrus-based gel is formulated to at least partially separate the pigmented layer from the metal surface, and wherein the citrus-based gel is formulated to not abrade the vinyl surface and the adhesive surface;

applying heat not exceeding 150° F. to the coat of citrus-based gel;

removing, after applying the heat, the coat of citrus-based gel, thereby removing at least a portion of the pigmented layer from the metal surface; and separating a remaining pigmented layer from the metal surface using a pick tool or a gust of air.

9. The method of claim 8, comprising:

determining a type associated with the pigmented layer, wherein the type includes paint, powder coat, or enamel;

based on the type associated with the pigmented layer, determining a predetermined amount of time;

after applying the heat, waiting for the predetermined amount of time; and removing the coat of citrus-based gel after the predetermined amount of time.

10. The method of claim 8, comprising:

prior to applying the coat of citrus-based gel, cleaning the metal surface covered with the pigmented layer using soap and water.

11. The method of claim 8, comprising:

after adhering the stencil layer to the metal surface covered with the pigmented layer, removing wrinkles and bubbles from the stencil layer by:

sliding a first surface across the stencil layer; and pressing the stencil layer down onto the metal surface covered with the pigmented layer.

12. The method of claim 8, comprising:

after adhering the stencil layer to the metal surface covered with the pigmented layer, aiding the adhesive surface to adhere to the metal surface covered with the pigmented layer by:

applying heat to the stencil layer; and applying pressure with a roller to the stencil layer.

13. The method of claim 8, comprising:

prior to applying heat not exceeding 150° F. to the coat of citrus-based gel, enclosing the coat of citrus-based gel and the metal surface covered with the pigmented layer using a flexible sheet; and uniformly distributing the heat across the citrus-based gel by applying the heat not exceeding 150° F. to the coat of citrus-based gel through the flexible sheet.

14. The method of claim 8, comprising:

after applying the heat, determining whether the pigmented layer is separating from the metal surface; and selectively applying additional coat of citrus-based gel or removing the coat citrus-based gel based on whether the pigmented layer is separating from the metal surface.

15. A method comprising:

applying a stencil defining the design to a stencil layer, wherein the stencil layer includes a vinyl surface and an adhesive surface;

adhering the stencil layer to the metal surface covered with a pigmented layer, wherein the adhesive surface attaches to the metal surface covered with the pigmented layer;

applying a coat of citrus-based gel, wherein the citrus-based gel is formulated to at least partially separate the pigmented layer from the metal surface, and wherein the citrus-based gel is formulated to not abrade the vinyl surface and the adhesive surface;

applying heat not exceeding 150° F. to the coat of citrus-based gel;

removing, after applying the heat, the coat of citrus-based gel, thereby removing at least a portion of the pigmented layer from the metal surface; and separating a remaining pigmented layer from the metal surface using a pick tool or a gust of air.

16. The method of claim 15, comprising:

determining a type associated with the pigmented layer, wherein the type includes paint, powder coat, or enamel;

based on the type associated with the pigmented layer, determining a predetermined amount of time;

after applying the heat, waiting for the predetermined amount of time; and removing the coat of citrus-based gel after the predetermined amount of time.

17. The method of claim 15, comprising:

prior to applying the coat of citrus-based gel, cleaning the metal surface covered with the pigmented layer using soap and water.

18. The method of claim 15, comprising:

after adhering the stencil layer to the metal surface covered with the pigmented layer, removing wrinkles and bubbles from the stencil layer by:

sliding a first surface across the stencil layer; and pressing the stencil layer down onto the metal surface covered with the pigmented layer.

19. The method of claim 15, comprising:

after adhering the stencil layer to the metal surface covered with the pigmented layer, aiding the adhesive surface to adhere to the metal surface covered with the pigmented layer by:

applying heat to the stencil layer; and applying pressure with a roller to the stencil layer.

20. The method of claim 15, comprising:

prior to applying heat not exceeding 150° F. to the coat of citrus-based gel, enclosing the coat of citrus-based gel and the metal surface covered with the pigmented layer using a flexible sheet; and uniformly distributing the heat across the citrus-based gel by applying the heat not exceeding 150° F. to the coat of citrus-based gel through the flexible sheet.

* * * * *